US010563463B2

(12) United States Patent
Simmons et al.

(10) Patent No.: US 10,563,463 B2
(45) Date of Patent: Feb. 18, 2020

(54) EARTH BORING TOOL WITH IMPROVED ARRANGEMENTS OF CUTTER SIDE RAKES

(71) Applicant: Ulterra Drilling Technologies, L.P., Fort Worth, TX (US)

(72) Inventors: Rob A. Simmons, Arlington, TX (US); Carl Aron Deen, Fort Worth, TX (US); Andrew David Murdock, Fort Worth, TX (US)

(73) Assignee: Ulterra Drilling Technologies, L.P., Fort Worth, TX (US)

( * ) Notice: Subject to any disclaimer, the term of this patent is extended or adjusted under 35 U.S.C. 154(b) by 109 days.

(21) Appl. No.: 15/396,409

(22) Filed: Dec. 30, 2016

(65) Prior Publication Data

US 2017/0211336 A1 Jul. 27, 2017

Related U.S. Application Data

(63) Continuation of application No. 14/093,994, filed on Dec. 2, 2013, now Pat. No. 9,556,683.

(60) Provisional application No. 61/732,897, filed on Dec. 3, 2012.

(51) Int. Cl.

| | |
|---|---|
| ***E21B 10/55*** | (2006.01) |
| ***E21B 10/567*** | (2006.01) |
| ***E21B 10/46*** | (2006.01) |
| ***E21B 10/43*** | (2006.01) |

(52) U.S. Cl.

CPC ..... *E21B 10/55* (2013.01); *E21B 10/43* (2013.01); *E21B 10/46* (2013.01); *E21B 10/567* (2013.01)

(58) Field of Classification Search

CPC ..... E21B 10/55; E21B 10/46; E21B 10/567; E21B 10/43

See application file for complete search history.

(56) References Cited

U.S. PATENT DOCUMENTS

| | | | |
|---|---|---|---|
| 3,174,564 | A | 3/1965 | Morlan |
| 4,440,247 | A | 4/1984 | Sartor |
| 4,471,845 | A | 9/1984 | Jurgens |
| 4,545,441 | A | 10/1985 | Williamson |
| 5,172,777 | A | 12/1992 | Siracki et al. |
| 5,531,281 | A | 7/1996 | Murdock |
| 5,549,171 | A | 8/1996 | Mensa-wilmot et al. |
| 5,649,604 | A | 7/1997 | Fuller et al. |
| 5,655,614 | A | 8/1997 | Azar |
| 5,695,019 | A | 12/1997 | Shamburger, Jr. |

(Continued)

FOREIGN PATENT DOCUMENTS

| | | |
|---|---|---|
| AU | 2005101019 | 1/2006 |
| EP | 0427816 A1 | 5/1991 |

(Continued)

OTHER PUBLICATIONS

U.S. Appl. No. 14/626,736 , "Final Office Action", dated Oct. 3, 2018, 22 pages.

(Continued)

*Primary Examiner* — Brad Harcourt

(74) *Attorney, Agent, or Firm* — Kilpatrick Townsend & Stockton LLP

(57) ABSTRACT

Earth boring tools with a plurality of fixed cutters have side rake or lateral rakes configured for improving chip removal and evacuation, drilling efficiency, and/or depth of cut management as compared with conventional arrangements.

15 Claims, 6 Drawing Sheets

(56) References Cited

U.S. PATENT DOCUMENTS

| | | | | |
|---|---|---|---|---|
| 6,164,394 | A | 12/2000 | Mensa-wilmot et al. | |
| 6,296,069 | B1 | 10/2001 | Lamine et al. | |
| 6,527,066 | B1 | 3/2003 | Rives | |
| 6,637,808 | B1 | 10/2003 | Ling et al. | |
| 7,441,612 | B2 | 10/2008 | Durairajan et al. | |
| 7,703,557 | B2 | 4/2010 | Durairajan et al. | |
| 7,762,355 | B2 | 7/2010 | McClain et al. | |
| 8,047,307 | B2 | 11/2011 | Pessier et al. | |
| 8,112,258 | B2 | 2/2012 | Durairajan et al. | |
| 8,881,849 | B2 | 11/2014 | Shen et al. | |
| 8,887,839 | B2 | 11/2014 | Vempati et al. | |
| 9,016,409 | B2 | 4/2015 | Zhang et al. | |
| 2006/0162968 | A1 | 7/2006 | Durairajan et al. | |
| 2007/0261890 | A1 | 11/2007 | Cisneros | |
| 2009/0266614 | A1* | 10/2009 | Meister | E21B 10/32 175/57 |
| 2010/0193253 | A1 | 8/2010 | Massey et al. | |
| 2010/0326742 | A1* | 12/2010 | Vempati | E21B 10/43 175/431 |
| 2011/0005841 | A1* | 1/2011 | Wood | E21B 10/26 175/385 |
| 2011/0284293 | A1 | 11/2011 | Shen et al. | |
| 2012/0153705 | A1 | 6/2012 | Reynolds et al. | |
| 2012/0205962 | A1 | 8/2012 | Hagenbuch | |
| 2012/0234610 | A1 | 9/2012 | Azar et al. | |
| 2012/0312603 | A1 | 12/2012 | Propes et al. | |
| 2016/0047170 | A1 | 2/2016 | Matthias et al. | |

FOREIGN PATENT DOCUMENTS

| | | | |
|---|---|---|---|
| EP | 2118431 | B1 | 11/2011 |
| NG | PT/C/2015/1171 | | 11/2018 |
| SU | 592956 | | 2/1978 |
| SU | 1472623 | A1 | 4/1989 |
| WO | 9012192 | A1 | 10/1990 |
| WO | 2010080477 | A2 | 7/2010 |
| WO | 2012021925 | A1 | 2/2012 |

OTHER PUBLICATIONS

U.S. Appl. No. 14/626,736 , "Non-Final Office Action", dated Mar. 15, 2019, 22 pages.

Mexican Application No. MX/A/2015/007020 , "Office Action", dated Feb. 22, 2019, 3 pages.

European Application No. EA201500602, "Office Action", dated Apr. 23, 2019, 5 pages.

European Application No. EP18196223.4, "Extended European Search Report", dated Jul. 2, 2019, 9 pages.

Canadian Application No. 2,892,600, "Office Action", dated Nov. 12, 2019, 4 pages.

Indian Application No. 5311/DELNP/2015, "First Examination Report", dated Oct. 10, 2019, 9 pages.

* cited by examiner

EARTH BORING TOOL WITH IMPROVED ARRANGEMENTS OF CUTTER SIDE RAKES

RELATED APPLICATION

This application is a continuation of U.S. patent application Ser. No. 14/093,994 filed Dec. 2, 2013, which claims the benefit of U.S. patent application Ser. No. 61/732,897 filed Dec. 3, 2012, the entirety of which is hereby incorporated by reference.

FIELD OF INVENTION

The invention pertains generally to drill bits, reamers and similar downhole tools for boring earth formations using fixed cutters on a rotating body.

BACKGROUND

Rotary drag bits, reamers, and similar downhole tools for boring or forming holes in subterranean rock formations when drilling oil and natural gas wells drag discrete cutting structures, which use cutting elements referred to as "cutters," mounted in fixed locations on body of the tool, against the formation by rotating the body of the tool. The rotation of the tool enables the cutters to fracture the formation through a shearing action, resulting in formation of small chips that are then evacuated hydraulically by drilling fluid pumped through carefully placed nozzles in the body of the tool.

One such fixed cutter, earth boring tool, generally referred to in the oil and gas exploration industry as a PDC bit, employs fixed cutters having a highly wear resistant cutting or wear surface comprised of a polycrystalline diamond compact (PDC) or similar highly wear resistant material. PDC cutters are typically made by forming a layer of polycrystalline diamond (PCD), sometimes called a crown or diamond table, on an erosion resistant substrate. The PDC wear surface is comprised of sintered polycrystalline diamond (either natural or synthetic) exhibiting diamond-to-diamond bonding. Polycrystalline cubic boron nitride, wurtzite boron nitride, aggregated diamond nanotubes (ADN) or other hard, crystalline materials are known substitutes and may be useful in some drilling applications. A compact is made by mixing a diamond grit material in powder form with one or more powdered metal catalysts and other materials, forming the mixture into a compact, and then sintering it with, typically, a tungsten carbide substrate using high heat and pressure or microwave heating. Sintered compacts of polycrystalline cubic boron nitride, wurtzite boron nitride, ADN and similar materials are, for the purposes of description contained below, equivalents to polycrystalline diamond compacts and, therefore, a reference to "PDC" in the detailed description should be construed, unless otherwise explicitly indicated or context does not allow, as a reference to a sintered compacts of polycrystalline diamond, cubic boron nitride, wurtzite boron nitride and other highly wear resistant materials. References to "PDC" are also intended to encompass sintered compacts of these materials with other materials or structure elements that might be used to improve its properties and cutting characteristics. Furthermore, PDC encompasses thermally stable varieties in which a metal catalyst has been partially or entirely removed after sintering.

Substrates for supporting a PDC wear surface or layer are typically made, at least in part, from cemented metal carbide, with tungsten carbide being the most common.

Cemented metal carbide substrates are formed by sintering powdered metal carbide with a metal alloy binder. The composite of the PDC and the substrate can be fabricated in a number of different ways. It may also, for example, include transitional layers in which the metal carbide and diamond are mixed with other elements for improving bonding and reducing stress between the PCD and substrate.

Each PDC cutter is fabricated as a discrete piece, separate from the drill bit. Because of the processes used for fabricating them, the PCD layer and substrate typically have a cylindrical shape, with a relatively thin disk of PCD bonded to a taller or longer cylinder of substrate material. The resulting composite can be machined or milled to change its shape. However, the PCD layer and substrate are typically used in the cylindrical form in which they are made.

Fixed cutters are mounted on an exterior of the body of an earth boring tool in a predetermined pattern or layout. Furthermore, depending on the particular application, the cutters are typically arrayed along each of several blades, which are comprised of raised ridges formed on the body of the earth boring tool. In a PDC bit, for example, blades are generally arrayed in a radial fashion around the center axis (axis of rotation) of the bit. They typically, but do not always, curve in a direction opposite to that of the direction of rotation of the bit.

As an earth boring tool with fixed cutters is rotated, the cutters collectively present one or more predetermined cutting profiles to the earth formation, shearing the formation. A cutting profile is defined by the position and orientation of each of the cutters associated with it as they rotate through a plane extending from the earth boring tool's axis of rotation outwardly. A cutter's position along the cutting profile is primarily a function of its lateral displacement from the axis of rotation and not the particular blade on which it lies. Cutters adjacent to each other in a cutting profile are typically not next to each other on the same blade.

In addition to position or location on the bit, each cutter has an orientation. Generally, this orientation will be defined with respect to one of two coordinate frames: a coordinate frame of the bit, defined in reference to its axis of rotation; or a coordinate frame generally based on the cutter itself. The orientation of a cutter is usually specified in terms of a side inclination or rotation of the cutter and forward/back inclination or rotation of the cutter. Side inclination is typically specified in terms lateral rake or side rake angle, depending on the frame of reference used. Back inclination is specified in terms of an axial rake or back rake angle, depending on frame of reference used.

SUMMARY

The invention relates generally to earth boring tools with a plurality of fixed cutters with side inclinations arranged in predetermined patterns for improving chip removal and evacuation, drilling efficiency, and/or depth of cut management as compared with conventional arrangements.

DETAILED DESCRIPTION OF EXEMPLARY EMBODIMENTS

In the following description, like numbers refer to like elements.

A typical fixed cutter, particularly a PDC cutter, will be generally cylindrical in shape, with a generally flat top that functions as its primary working surface. However, a cutter does not have to be, and is not always, perfectly cylindrical or symmetrical. A fixed cutter will have one or more working surfaces for engaging the formation and performing the work of fracturing it. For a fixed cutter, the cutting face is comprised of one or more surfaces of the cutter that are intended to face and engage the formation, and thus perform the work of fracturing the formation. These surfaces will tend to experience the greatest reactive force from the formation. For cylindrically shaped cutters, the generally flat PCD layer of the cylinder functions as the primary cutting surface, and therefore the orientation of this surface can be used to specify the orientation of the cutter on the bit using, for example, a vector normal to the plane of this surface, as well as a vector in the plane of this surface. On a PDC cutter, for example, the primary cutting surface is comprised of the top, relatively flat surface of the layer of PCD, and the center axis of the cylindrical cutter will be normal to it and centered on it. However, the exposed sides of the layer of PCD may perform some work and might be considered to be a working or cutting surface or part of the cutting face. PDC bits may also have, for example, a portion of the top edge of the cutter beveled or chamfered. Furthermore, a portion of a cutting surface might not be flat or planar.

Fixed cutters on drag bits, reamers and other rotating bodies for boring through rock will typically have at least a predominate portion of their primary cutting surface that is relatively, or substantially, planar or flat. It might not be perfectly so, but as compared to a surface that is noticeably rounded, cone shaped, or some other shape, it is relatively flat. For purposes of specifying orientation of a cutter, the following description adopts, unless the otherwise indicated, a vector normal to the plane of this relatively flat portion of the predominate cutting surface. This vector will be referred to as the main axis or orientation axis of the cutter for purposes of the following description. Because cylindrically shaped cutters are assumed for the following description, the central axis of the cutter will, unless indicated otherwise, be the main axis of the cutter in the examples given for FIGS. 1, 2A and 2B. However, the choice of this convention is not intended to limit the concepts described below. Other conventions for specifying the location and orientation of a cutter's primary cutting surface could be used.

Figure 1:
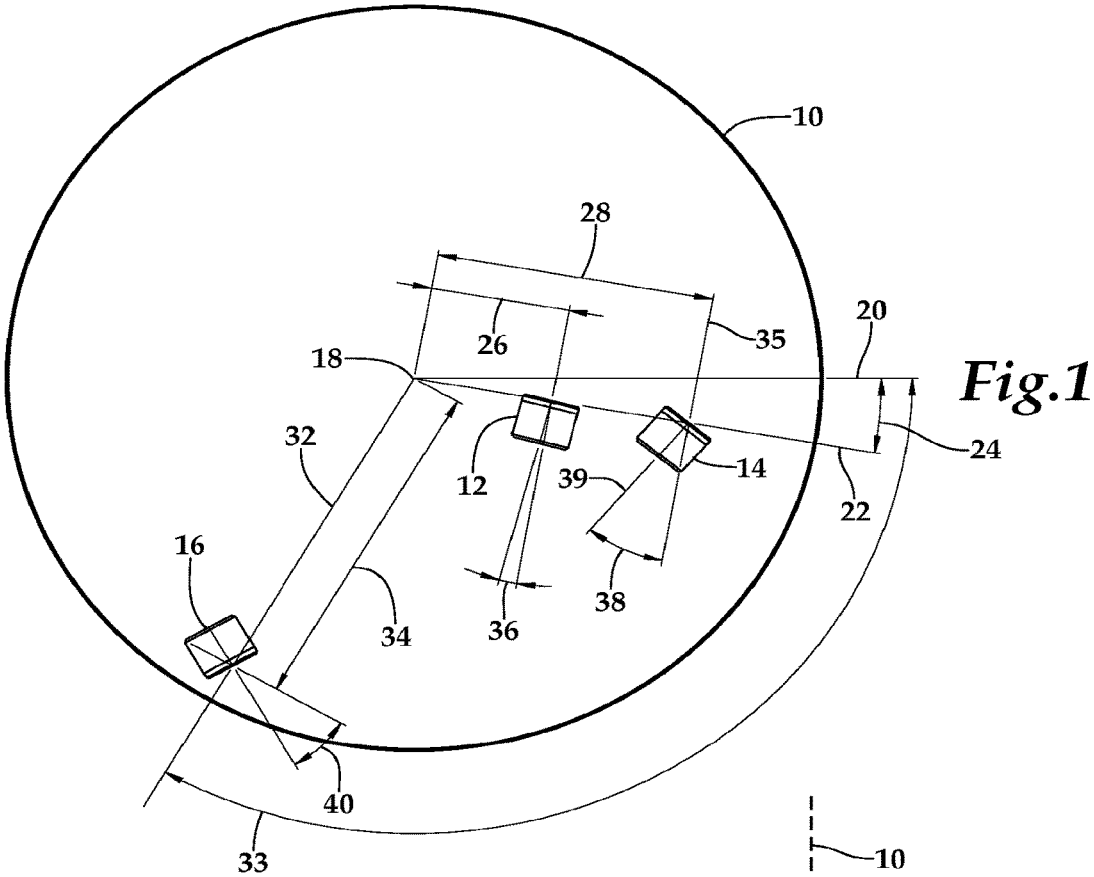
FIG. 1 represents a schematic illustration of a face view of the rotary drag bit.

FIG. 1 represents a schematic illustration of a face view of the bit, and is intended to illustrate the concept of lateral rake. The gauge of the bit is generally indicated by circle 10. Only three fixed cutters 12, 14, and 16 are illustrated for sake of clarity. Reference number 18 identifies the center of rotation of the bit in FIG. 1, and the axis of rotation in FIG. 2A. Radial line 20 represents zero degrees angular rotation around axis 18. Fixed cutters 12 and 14 are located generally on the same radial line 22, at the same angular rotation, as indicated by angle 24, but they are radially displaced different distances 26 and 28. They are located on the same blade, which is not indicated on the schematic representation. Cutters on the same blade do not, however, always all lie on the same radial line or at the same angular rotation around axis 18. Typically, they in fact do not. Cutter 16 lies on the radial line 32, which has a substantially larger angular position, as indicated by angle 33. Its radial displacement from the axis of rotation is indicated by distance 34, which is greater than the distances of the other two cutters 12 and 14.

Each of the cutters 12, 14, and 16 are shown having different amounts of lateral rake, which are indicated by angles 36, 38 and 40, respectively. Lateral rake is defined by the angle between (1) a line that is perpendicular to the radial line for that cutter through a point defined by the intersection of the cutting surface of the cutter and the main axis of the cutter and (2) the main axis of the cutter. In the case of cutter 14, for example, the lateral rake angle 38 is defined between line 35, which is perpendicular to the radial line and main axis 39 of the cutter. To simplify the illustration none of the cutters is shown having any back rake, but the definition above is true for cutters with backrake.

Figure 2A:
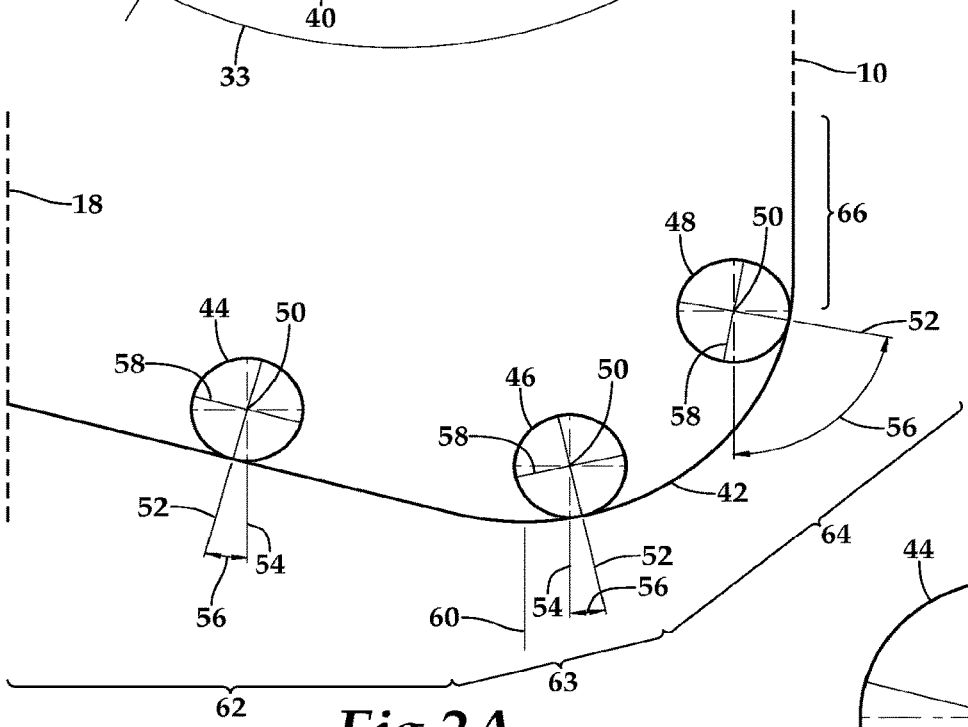
FIG. 2A is schematic illustration of a cutting profile for a PDC bit.

Curve 42 of FIG. 2A represents the cutting profile of the bit of FIG. 1, with the outer diameters of the individual cutters 12, 14, and 16 represented by circular outlines 44, 46, and 48, respectively. The profiles of the cutters are formed by rotating their positions to the zero degree angular rotation radial line 20 (FIG. 1) and projecting them into a plane in which the axis of rotation 18 and the zero degree angular rotation radial line 20 lie. Curve 42, which represents the cutting profile of the bit, touches each cutter at one point, and generally represents the intended cross-sectional shape in the borehole left by the bit as it is penetrating the formation. However, each of the outlines, 44, 46 and 48, assume for purposes of simplifying the illustration that the cutters do not have any backrake or side rake. If a cutter had any back rake or side rake, the projection of the outside diameter of the PCD layer into a plane through the radial line for that cutter would be elliptical.

Figure 2B:
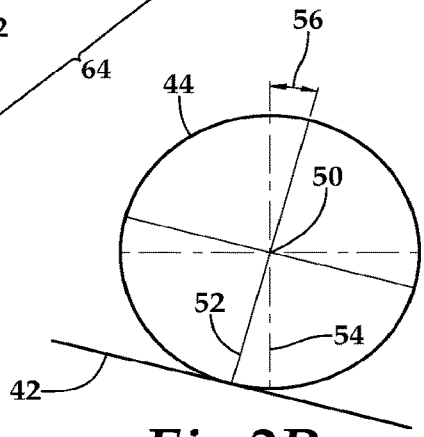
FIG. 2B is a schematic illustration of one of the cutters from FIG. 2A.

Referring now also to FIG. 2B, point 50 is point at which the main axis of the cutter, which in this example is assumed to be the center axis of the cutter, intersects a planer portion of the cutting face. This point will be selected, for purposes of example, as the origin of a reference frame for defining side rake and back rake of the cutter in the following description. Line 52 represents the side rake axis, which is the axis about which the cutter is rotated to establish side rake. The side rake axis is normal to the tangent to the cutter profile at the point where the projection of the cutter diameter 44 touches the bit cutting profile curve 42, and extends through point 50. Line 54, which crosses the cutter's main axis and is parallel to the axis of rotation 18, represents the lateral rake axis of the cutter. Angle 56 between side rack axis 52 and lateral rake axis 54 relates to the cutter profile angle. The angle of rotation (not indicated) of a cutter about the side rake axis 52 is its side rake angle. Line 58 represents the cutter's back rake axis. Rotation of the cutter around this axis defines the back rake angle of the cutter. The back rake axis is orthogonal to the cutter's main axis and the side rake axis 52.

Line 60 represents the zero angle for the cutting profile. Section 62 of the cutting profile corresponds to the cone of a PDC bit. The profile angles in this section are somewhere between 270 degrees and 360 (or zero) degrees The profile angles increase toward 360 degrees starting from the axis of rotation 18 and moving toward the zero degree profile angle at line 60. The bit's nose corresponds generally to section 63 of the cutting profile, in which the profile angles are close to zero degrees. Portion 64 of the profile corresponds to the bit's shoulder section. The profile angles increases quickly in this section until they reach 90 degrees. Within section 66 of the cutting profile, corresponding to the gauge section of the bit, the cutting profile is approximately at ninety degrees.

Figure 3B:
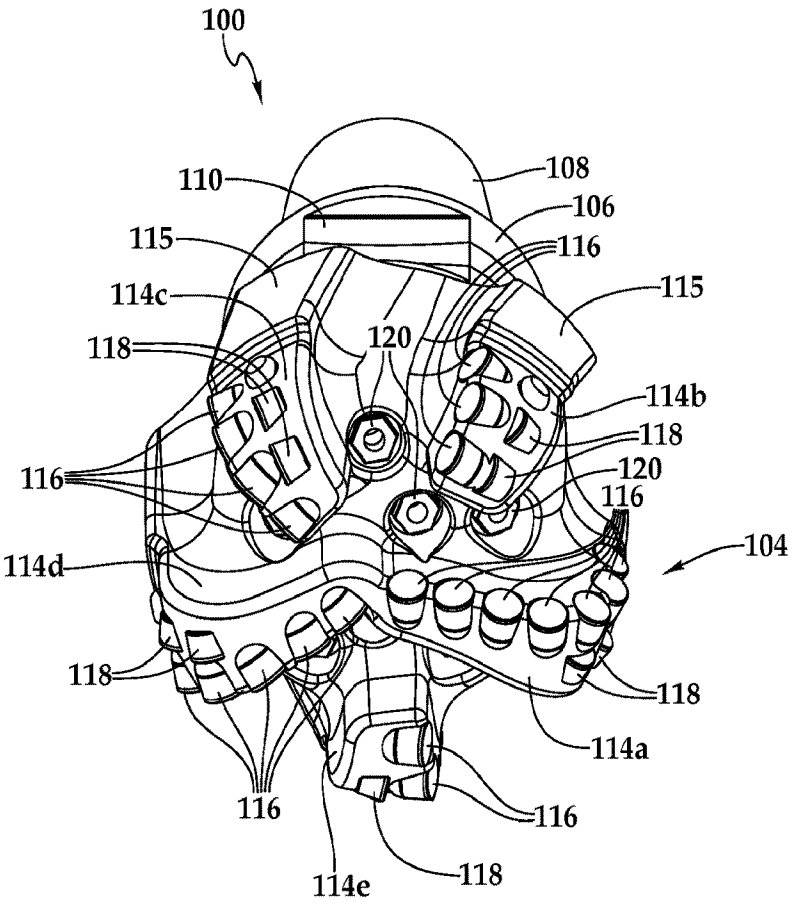
FIG. 3B is a perspective view of the PDC bit of FIG. 3A.
Figure 3A:
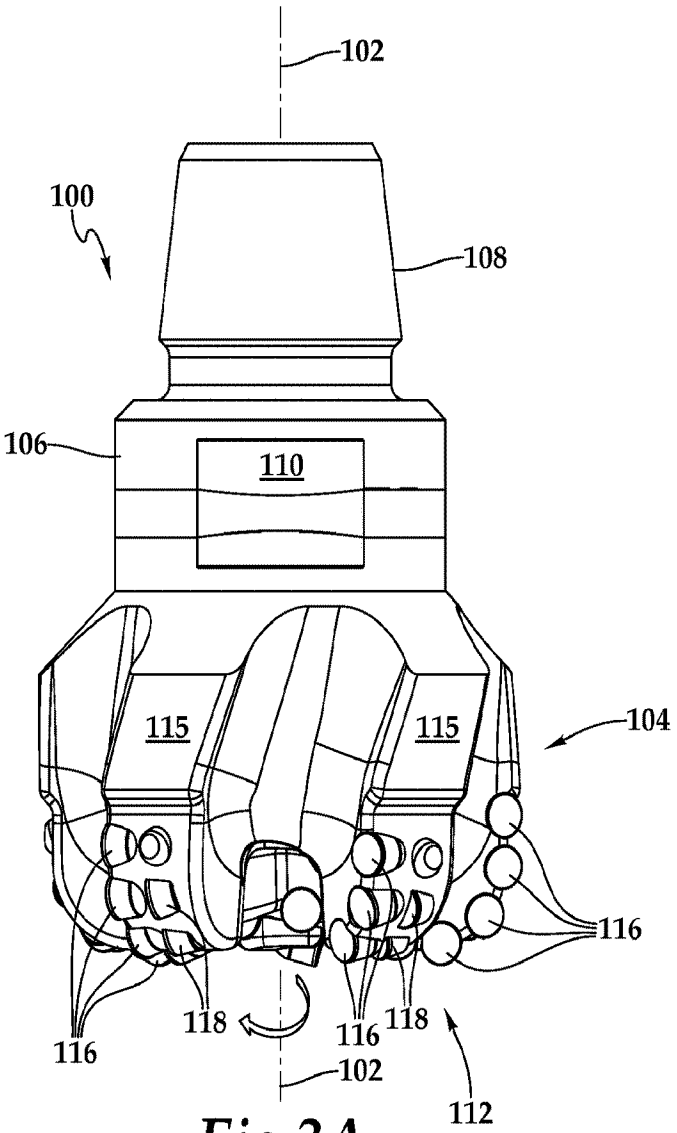
FIG. 3A is a side view of a representative example of a PDC bit.
Figure 3C:
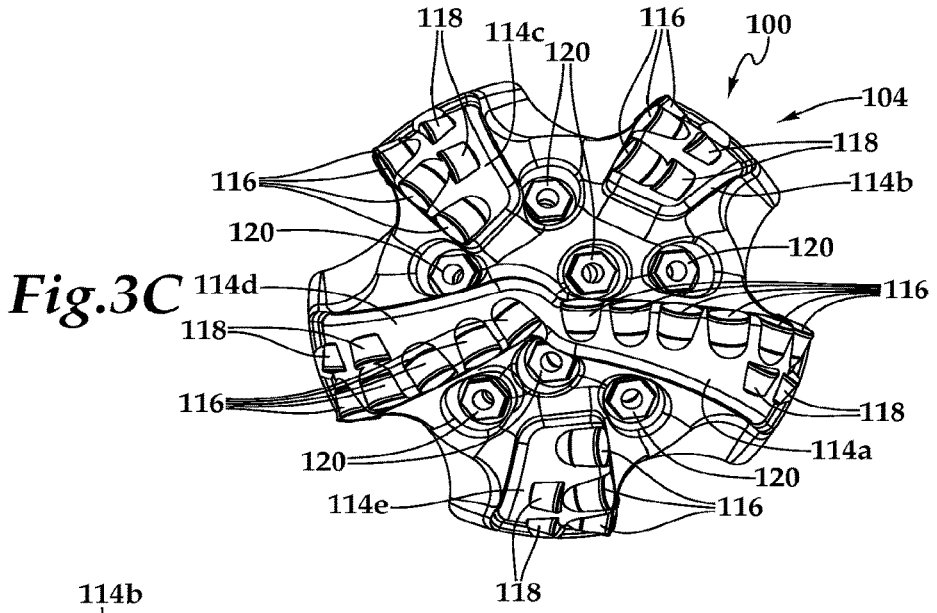
FIG. 3C is a face view of the PDC bit of FIG. 3A.

Referring now to FIGS. 3A to 3C, PDC bit 100 is a representative example generally of an earth boring downhole tool and more specifically a representative example of a rotary drag bit with PDC cutters. It is designed to be rotated around its central axis 102. It is comprised of a bit body 104 connected to a shank 106. It also comprises in this example a tapered threaded coupling 108 for connecting the bit to a drill string and a bit breaker surface 110 for cooperating with a bit breaker to tighten and loosen the coupling to the drill string. The exterior surface of the body that is intended to face generally in the direction of boring is referred to as the face of the bit and is generally designated by reference number 112.

Disposed on the bit face are a plurality of raised blades 114*a*-114*e*. Each blade extends generally in a radial direction, outwardly to the periphery of the cutting face. In this example, there are five blades spaced around the central axis 102, and each blade sweeps or curves backwardly relative to the direction of rotation. Blades 114*a* and 114*d* in this particular example have segments or sections located in along the cone of the bit body. All five blades in this example either start or have a segment or section on the nose of the bit body, in which the angle of the cutting profile is around zero, a segment along the shoulder of the bit body, which is characterized by increasing profile angles, and a segment on the gauge. The body includes a plurality of gauge pads 115 located at the end of each of the blades.

Disposed on each blade is a plurality of discrete cutting elements, or cutters 116, that collectively are part of the bits primary cutting profiles. Located on each of the blades, in this example, are a set of back up cutters 118 that often, collectively, form a second cutting profile for the bit. In this example, all of the cutters 116 and 118 are PDC cutters, with a wear or cutting surface made of super hard, polycrystalline diamond, or the like, supported by a substrate that forms a mounting stud for placement in each pocket formed in the blade. Nozzles 120 are positioned in the body to direct drilling fluid along the cutting blades to assist with evacuation of rock cuttings or chips and to cool the cutters.

Figure 4:
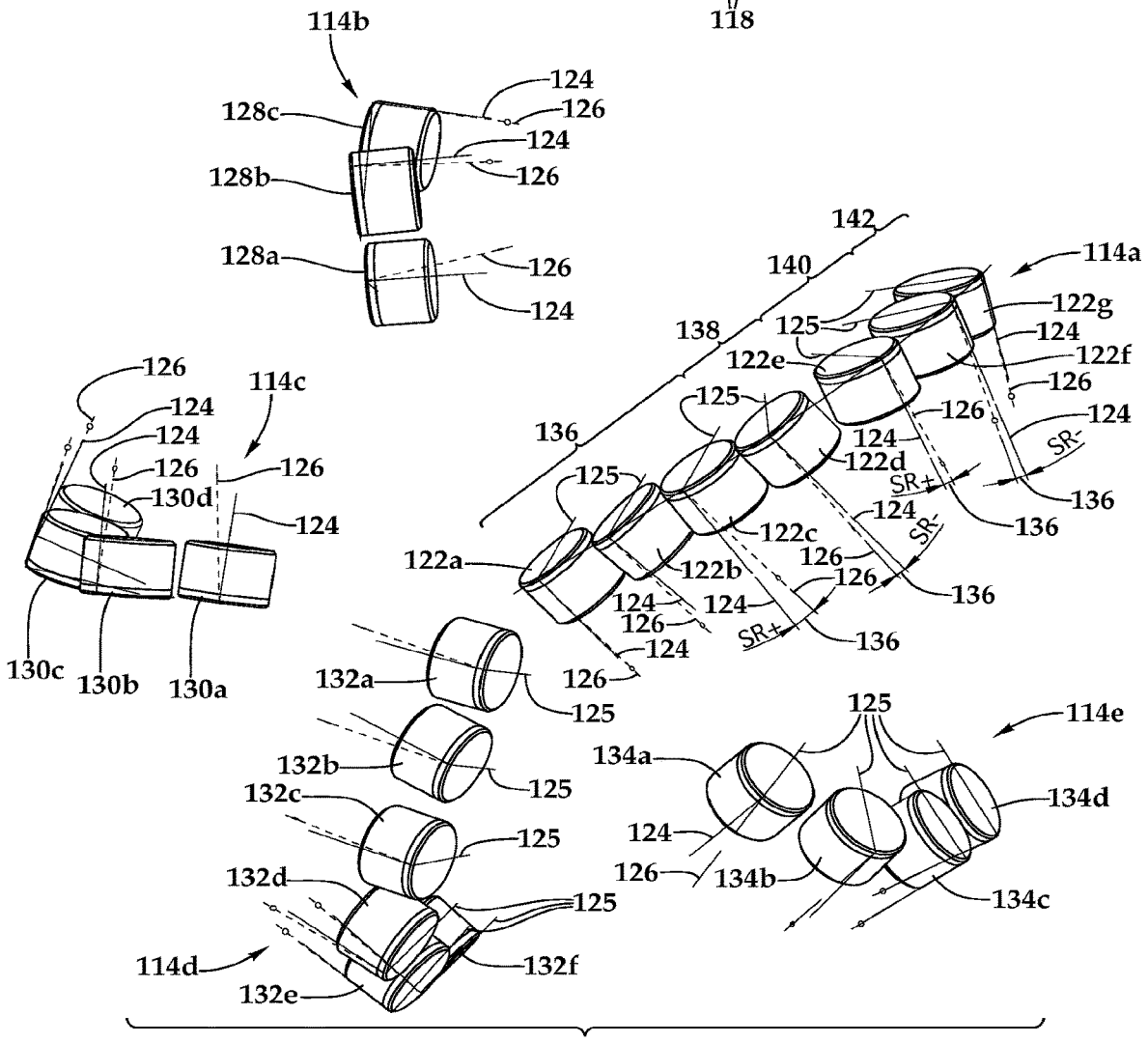
FIG. 4 is an axonometric view of selected PDC cutters from the PDC bit of FIGS. 3A-3C, to illustrate better the side rake of the cutters.

FIG. 4 removes the bit body and backup cutters 118 of the exemplary PDC bit of FIGS. 3A and 3C, leaving only the cutters of the primary cutting profile, to reveal better the orientations of the cutters 116. Cutters 122*a*-122*g* correspond generally to the cutters 116 on blade 114*a* in FIGS. 3A-3C; cutters 128*a*-128*c* correspond to the cutters 116 on blade 114*b*; cutters 130*a*-130*d* correspond to the cutters 116 of blade 114*c*; cutters 132*a*-132*f* correspond to the cutters on blade 114*d*; and cutters 134*a*-134*d* correspond to the cutters 116 on blade 114*e*.

In this particular example, cutters 122*a*-122*c* on blade 114*a* are located on a segment or section 136 of the blade generally on the cone of the bit, and cutter 122*d* is located on a nose segment or section 138 of the blade on the nose of the bit. Cutters 122*e* and 122*f* are on a shoulder segment 138 of the blade extending along the shoulder of the bit body. And cutter 122*g* is located on a gauge portion or segment 142 of the blade one the gauge of the bit. The cutters 132*a*-132*f* are also arrayed along the cone, nose, shoulder and gauge segments of blade 114*d*. The cutter 128*a*-128*c*, 130*a*-130*c*, and 134*a*-134*d* generally occupy only the nose, shoulder and gauge segments or portions of their respective 114*b*, 114*c* and 114*e*. In alternative embodiments, the bit could have a different numbers of blades, blade lengths and locations, and/or cutters on each blade.

The side rake axis for each cutter is perpendicular to the cutting profile and is indicated by a solid line 125. Solid line 124 indicates the orientation of the cutter's main axis, and is perpendicular to the side rake axis. The origin of both the side rake axis and the main axis shown here is the intersection of the cutter's PCD face and the cutting profile. Dashed line 126 indicates the zero degree side rake angle for the cutter. The angle 136 between the two lines is the cutter's side rake angle. The side rake angle follows the right-hand screw rule. So, for cutter 122*c*, rotation around the side rake axis 125 to the right is positive. Thus, the addition of cutter side rake has the effect of rotating the cutter's main axis 124, shown as a solid line, from its original position 126, which indicated the orientation of the cutter's main axis before side rake was applied. The effect of this is to angle the cutting face towards the gauge of the bit for this cutter, by approximately positive 10 degrees in this case, shown by angle 136. Conversely, cutter 122*d* has approximately negative 4 degrees side rake, it being rotated to the left around its side rake axis 125, having the effect of angling the cutting face towards the center of the bit. (Note that, for sake of clarity, not every side rake angle is explicitly identified in the illustration.) Because of the perspective of the drawing, the side rake angles may appears smaller than they actually are, or may appear to be non-existent.

In the example of FIG. 4, the largest difference in a side rake angle and in a lateral angle between any two cutters within a cutting profile on the bit is at least 4 degrees. Furthermore, the largest differences in side rake angles, the lateral rake angles, or both, on cutters located on the bit is also at least four degrees.

Figure 5A:
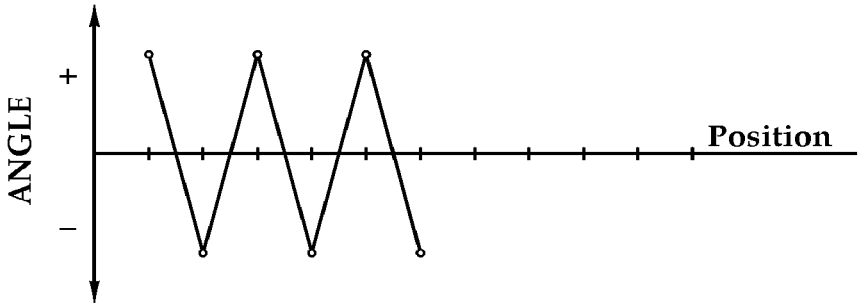
FIGS. 5A-5J are graphs plotting cutter position to a side inclination, such as side rake or lateral angle, and represent example of patterns of such angles across a blade or cutting profile of an earth boring tool with fixed cutters.

Although it might not be entirely clear from the FIG. 4, the changes or differences in side rake angles of cutters along at least blade 114*a* alternate directions, between positive and negative, and often by varying magnitudes. FIG. 5A illustrates an example of a similar change in rake angles and indicates how the direction of change alternates. In the example of blade 114*a*, this alternation occurs along the entire length of the blade 114*a*. In an alternative embodiment, this alternation occurs only along a portion of the blade, such as some or all of the cone section, the nose section and/or the shoulder. Furthermore, the side rake angles alternate between positive and negative over at least a portion of the blade, such as between cutters 122*b* to 122*f* in the illustrated example. However, positive and negative alteration could, in an alternative embodiment, occur over the entire length of the blade, or just one or more sections of the blade. The cutters on each of the additional blades 114*b*-114*e* also, in this example, have cutters with differences between side angles and/or lateral angles of the cutters alternating directions in a manner similar to blade 114*a*.

In alternative embodiments, one or more blades on the bit body have at least three adjacent cutters with side rake angle and/or lateral rake angles changing in alternating directions. In still further alternative embodiments, at least two of the three have alternate directions between positive and negative angles on each of the three blades. The at least three cutters cover least a portion of the length of blade, such as some or all of the cone, nose and/or shoulder sections, in one alternative embodiment, and up to the gauge in another embodiment.

Positive side rake or lateral rake angles will tend to push the piece of the formation being sheared away—sometimes referred to as a cutting, chip, or shaving—toward the periphery of the bit, away from the axis of rotation or center of the bit. Negative side rake or lateral rake angles tend to have the opposite effect. Placing next to a cutter with a neutral or positive side rake or lateral rake angle a cutter on the same blade with a smaller or a negative side angle, so that the faces of the cutters are oriented toward each other, can result in chips, as they are roll of the respective faces of the cutters, being pushed together. Depending on the type of formation, this may facilitate breaking apart the chips, making it easier to evacuate them through slots between the blades. Substantially altering the side rake or lateral rake of a next adjacent cutter in a cutting profile may aid in fracturing a particular type of formation. For example, the next cutter in the profile might have a side rake or lateral angle of an opposite polarity—negative instead of positive, for example—or a relatively large difference in side rake or lateral rake angle.

The graphs of FIGS. 5A to 5G illustrate various alternative embodiments of side rake or lateral rake configurations for fixed cutters on a rotary earth boring tool, such as a PDC bit or reamer. In one embodiment the x-axis represents successive positions of cutters along a blade. In another embodiment the x-axis represents successive radial positions of adjacent cutters within a bit's cutting profile. The origin represents, in these examples, the axis of rotation of the tool, with successive positions along the x-axis representing positions closer to the gauge of the body of the tool and more distant from the axis of rotation. However, the patterns illustrated could be used in intermediate sections of the cutting profile or intermediate sections of a blade. The y-axis indicates either the side rake angle or the lateral angle of the cutters. The graphs are not intended to imply any particular range of positions on a blade or within a cutting profile.

The configuration of FIG. 5A represents a configuration in which the differences or changes in side or lateral rake angles of at least three cutters in adjacent positions alternate directions. For example, the angle of the cutter in the first position and the angle of the cutter in the second position have opposite polarities. The direction of change or the difference is negative. The change between the cutters in the second and the third positions is a direction opposite the direction of the change from the first to the second cutter. The angle increases, and the difference in angles is positive.

Figure 5B:
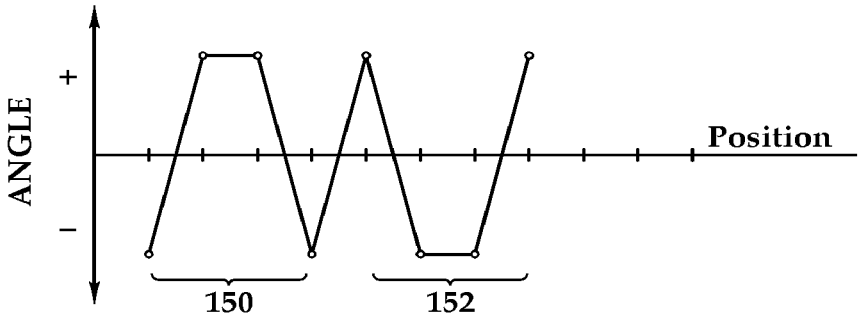

The pattern of FIG. 5B is similar to FIG. 5A, except that it is comprised of two related patterns 150 and 152, which are the inverse of each other. In each of these two patterns the change of the side rake or lateral rake angle from an individual cutter to a group of two (or more) cutters with a similar side rake or lateral rake angle is in one direction, and then the change in angle from the group to a single cutter is in the opposite direction.

Figure 5C:
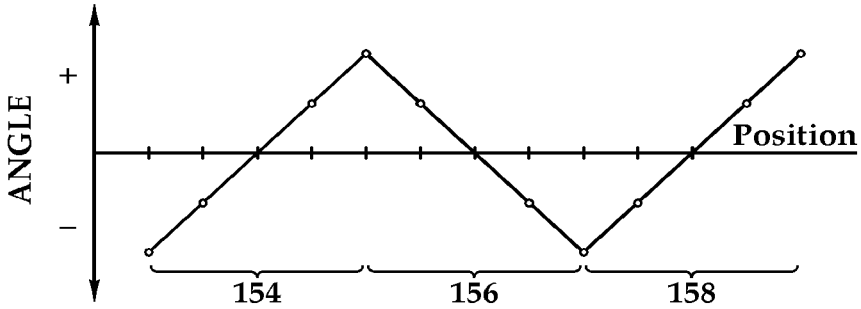

In the example configuration of FIG. 5C, the differences in side rake or lateral rake angles within group 154 of at least two successive cutters (four in the example) is in a first direction. The angle in this group progressively increases, in this example from negative to positive. In a next adjacent group 156 of two or more cutters, the lateral or side rake angles change in the opposite between adjacent members of cutters within that group. In this example, the angles decrease, and furthermore they decrease from being positive angles to negative angles. A third group of at least cutters 158, having increasing angles, and thus the direction of change in angle within this group is positive. The pattern thus illustrates an alternating of the direction of change within adjacent groups of cutters.

Figure 5D:
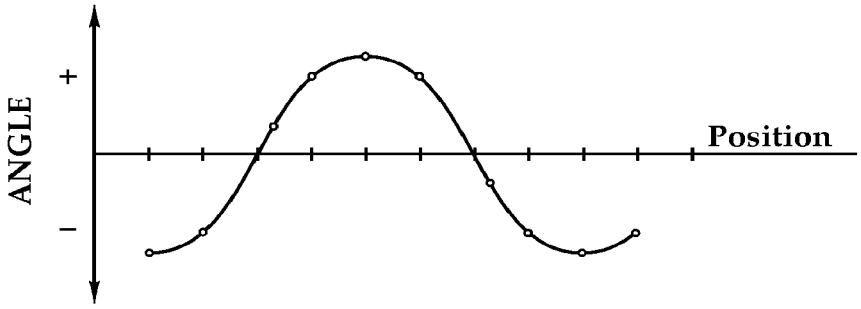

FIG. 5D is similar to FIG. 5C, except that the changes in side rake or lateral rake angles follow a sinusoidal pattern rather than the linear pattern.

Figure 5E:
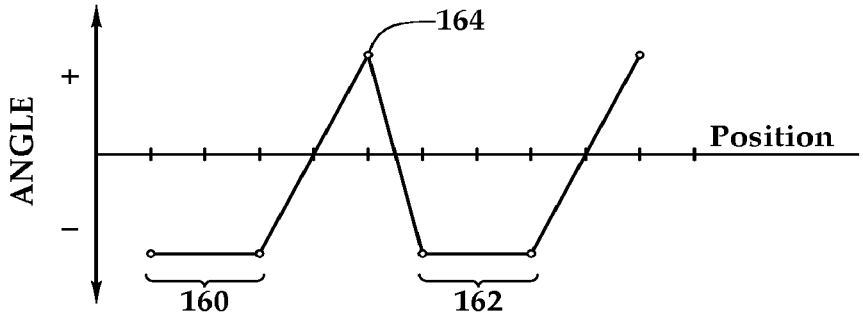

FIG. 5E shows an example of a pattern in which the side rake or lateral rake angles within groups 160 and 162 of two or more successive cutters are similar (for example, all the same magnitude, or all negative or positive) but that every third (or more) cutter 164 has a different angle (for example, positive when the angles in the groups 160 are negative). The angle changes in a first direction from group 160 to cutter 164, and then in the opposite direction between cutter 164 and group 162. Inverting the pattern is an alternative embodiment. The cutters having one polarity of side rake might be positioned on side of the bit and the cutters with the opposing polarity would be positioned on the other side of bit. For instance, one side rake would be used on blades 1 to 3 and the second side rake would be used on blades 4 to 6 of a six bladed bit.

Figure 5F:
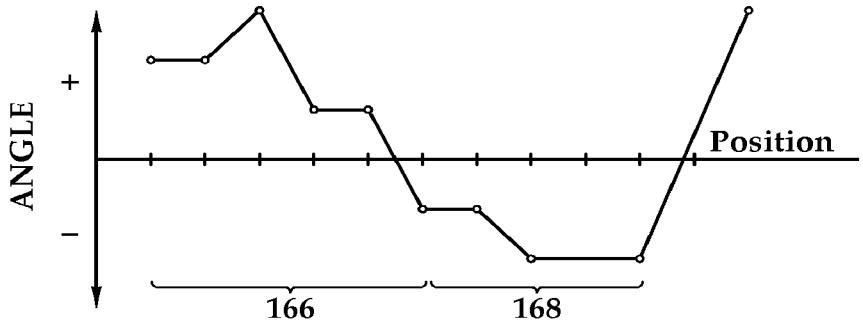

FIG. 5F is an example of pattern for a bit in which side or lateral rakes of two or more adjacent cutters with a group 166, for example within a cone of a bit, are positive, and then group of two or more adjacent cutters are negative in an adjacent a group 168. This second group could be, for example, along the nose and shoulder of the bit. The side or lateral rake angle then becomes positive again. The pattern also illustrates step-wise decreases or increases within a group.

Figure 5G:
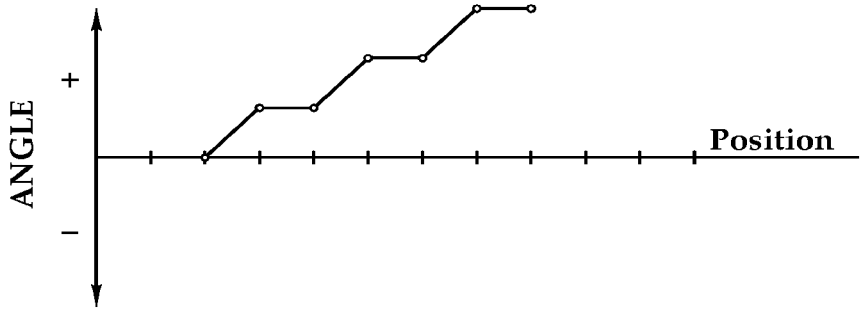

FIG. 5G is an example of a step-wise pattern or configuration in which the side or lateral rake angle is generally increasing. In this example, the side rake or lateral angle is increasing generally in a non-linear fashion, but the change in angle swings between an increasing direction and neutral. In this example the increasing positive side rake pushes cuttings increasingly to the outer diameter of the bit, increasing drilling efficiency.

In alternatives to the patterns or configurations of FIGS. 5A to 5D, patterns may be inverted. Furthermore, although the polarity of the angles (positive or negative) form part of the exemplary patterns, the values of the angles in alternative embodiments can be shifted positive or negative without changing other aspects of the pattern, namely the pattern in the directions of changes in the angle between adjacent cutters or group of cutters. In the configuration of FIG. 5A, for example, all of the cutters could have either positive or negative side rake without changing the alternating changes in direction of the differences between the cutters. Furthermore, the alternating pattern of positive and negative direction changes could occur first between cutters with positive angles, and then shift toward a mixture of positive and negative angles, and then toward all negative angles without interrupting the alternating pattern. Another alternative embodiment is a bit with, for instance, blades 1 to 3 having one side rake and blades 4 to 6 having the an opposing or substantially different side rake, similar to the arrangement shown in FIGS. 5E and 5F. This design could reduce walk tendency, and might be configured to be more laterally stable than a more conventional design.

Figure 5H:
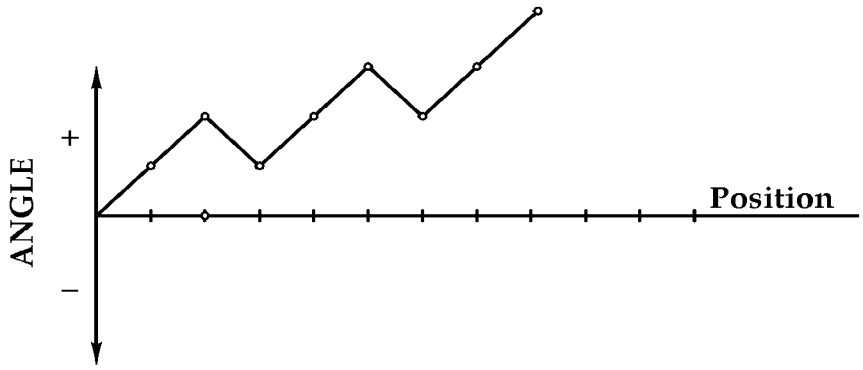
Figure 5I:
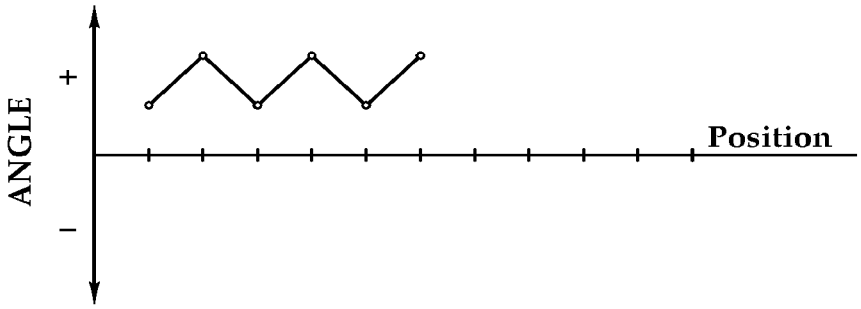
Figure 5J:
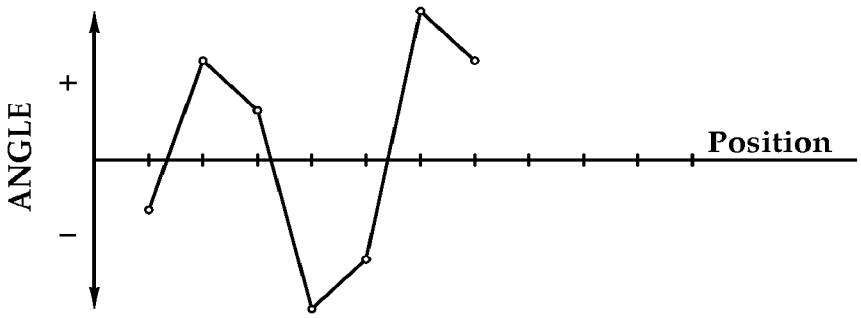

FIGS. 5H to 5J are additional examples of these alternative patterns. In FIG. 5H, the lateral and/or side rake angles are positive and generally increase. But, at some frequency, the angle decreases. In this example, the frequency is every third cutter in the sequence. However, a different frequency could be chosen, or the point at which the decrease occurs can be based on a transition between sections of the bit or blade, such as between cone and nose, nose and shoulder, and shoulder and gauge.

FIG. 5I is an alternative embodiment to FIG. 5A, in which the rake angles remain positive, but increase and decrease in an alternating fashion.

FIG. 5J illustrates that patterns of rake angle changes may also involve varying the magnitude of change in a rake angle between cutters in addition to direction.

Some of the benefits or advantages to adjusting side rakes and lateral rakes of fixed cutters on earth boring tools with patterns such as those described above include one or more of the following:

Chip removal and chip evacuation by managing chip growth and the breakage or removal of cutting chips. This may be enhanced by having hydraulics tuned to enhance chip removal and/or the chip breaking effects.

Improved drilling efficiency achieved by reduced vibration and torque, as a result of managed side forces, reduced imbalance force and/or more efficient rock failure mechanisms. These might be achieved by managing force directions. Rock fracture communication between cutters is enhanced with engineered use of side rakes during bit design including rock fracture communication between primary and backup cutters. The modified elliptical cut shapes achieved with the use of side rake can have a dramatic effect on improving drilling efficiency and can be further enhanced by the position, size and/or orientation of backup cutters. In addition, the strategic use of side rake near or on gauge can also improve steerability.

Depth of cut (DOC) management by using different side rakes to give variable elliptical cut shapes in consort with position of backup elements to better manage depth-of-cut. This design concept may be adopted in discrete locations on the bit to maximize the benefits.

The foregoing description is of exemplary and preferred embodiments. The invention, as defined by the appended claims, is not limited to the described embodiments. Alterations and modifications to the disclosed embodiments may be made without departing from the invention. The meaning of the terms used in this specification are, unless expressly stated otherwise, intended to have ordinary and customary meaning and are not intended to be limited to the details of the illustrated or described structures or embodiments.

What is claimed is:

1. A rotary apparatus for boring earth, comprising:

a body having a central axis, about which the apparatus is intended to rotate, the body comprising a cutting face, on which a plurality of outwardly extending blades are arranged; and a group of two or more primary PDC cutters mounted in fixed positions on the body, the group of primary cutters collectively defining at least a portion of a cutting profile for the apparatus when it is rotated, each of the primary cutters in the group of primary cutters having a cutting face, a predetermined radial position within the cutting profile based on its distance from the central axis, and a predetermined orientation for its cutting face, the predetermined orientation comprising a side inclination angle, which angle can be negative, zero, or positive;

wherein at least two primary cutters in the group of primary cutters are adjacent to each other in a row and have side inclination angles that differ from one another by at least 4 degrees; and wherein the at least two primary cutters in the group of primary cutters generally face toward each other.

2. The rotary apparatus of claim 1, wherein the at least two primary cutters have adjacent radial locations in a layout of the cutters on the body.

3. The rotary apparatus of claim 1, wherein the side inclination angle of at least one of the at least two primary cutters is positive, and the side inclination angle of another one of the at least two primary cutters is negative or zero.

4. The rotary apparatus of claim 1, wherein the side inclination angle of each cutter in the group of primary cutters is defined by the side rake of the cutter, the side rake comprising the angular orientation of the cutting face of the cutter about an axis that is normal to a tangent to the cutting profile at the radial position of that cutter.

5. The rotary apparatus of claim 1, wherein the side inclination angle of each cutter in the group of primary cutters is defined by the side rake of the cutter, the side rake comprising the angular orientation of the cutting face of the cutter about an axis that is normal to a tangent to the cutting profile at the radial position of that cutter, projected onto the plane of the cutting face.

6. A rotary apparatus for earth boring, comprising:

a body having a central axis, about which the apparatus is intended to rotate;

a plurality of blades formed on the body; and a group of primary cutters in fixed locations on the body, the group of primary cutters collectively defining a cutting profile for the apparatus when it is rotated, each cutter in the group of cutters having a cutting face, a predetermined position within the cutting profile, and a predetermined side inclination angle, which angle can be negative, zero, or positive;

wherein the group of primary cutters comprises a first primary cutter, a second primary cutter, and a third primary cutter at different radial positions within the cutting profile;

wherein the first primary cutter, the second primary cutter, and the third primary cutter are adjacent to each other in a row, and wherein the side inclination angle of the first cutter as compared to the second cutter changes in a first direction, and the side inclination angle of the third cutter as compared to the second cutter changes a second direction opposite the first direction.

7. The rotary apparatus of claim 6, wherein the side inclination angle of the first, second and third primary cutters is defined by the angular orientation of the cutting face of that cutter about an axis that is normal to a tangent to the cutting profile at the radial position of that cutter.

8. The rotary apparatus of claim 6, wherein the side inclination angle of the first, second and third primary cutters is defined by the angular orientation of the cutting face of that cutter about an axis that is normal to a tangent to the cutting profile at the radial position of that cutter, projected onto the plane of the cutting face.

9. The rotary apparatus of claim 6, wherein the first, second and third primary cutters have adjacent radial locations on the cutting profile.

10. The rotary apparatus of claim 6, wherein the side inclination angle of at least one of the first, second, and third primary cutters is positive, and the side inclination angle of at least another one of the first, second, and third primary cutters is negative or zero.

11. The rotary apparatus of claim 6, wherein the first primary cutter, the second primary cutter, and the third primary cutter are all positioned in a cone section of the cutting profile, a nose section of the cutting profile, or a shoulder section of the cutting profile.

12. A rotary apparatus for earth boring operations, comprising:

a body having a central axis, about which the apparatus is intended to rotate;

a plurality of blades formed on the body; and a plurality of primary PDC cutters arrayed on the body, the plurality of primary cutters collectively defining at least a portion of a cutting profile for the apparatus when it is rotated, each of the plurality of primary cutters having a cutting face, a predetermined radial position within the cutting profile, and a predetermined side inclination angle for the cutting face, which angle can be negative, zero, or positive;

wherein the plurality of primary cutters comprises a group of at least two adjacent primary cutters, a third primary cutter adjacent to the group in a row, and at least a fourth primary cutter adjacent to the third primary cutter in the row; and wherein the side inclination angles of each primary cutter in the group is the same, and the side inclination angle of the third primary cutter compared to the side inclination angle of each primary cutter in the group is changed in a first direction, and the side inclination angle of the fourth primary cutter as compared to the side inclination angle of the third primary cutter is changed in a second direction opposite the first direction.

13. The rotary apparatus of claim 12, wherein the side inclination angle of the group of at least two primary cutters, the third primary cutter and the fourth primary cutter is defined by the angular orientation of the cutting face of the particular cutter about an axis that is normal to a tangent to the cutting profile at the radial position of that cutter.

14. The rotary apparatus of claim 12, wherein the side inclination angle of the group of at least two primary cutters, the third primary cutter and the fourth primary cutter is defined by the angular orientation of the cutting face of the particular cutter about an axis that is normal to a tangent to the cutting profile at the radial position of that cutter, projected onto the plane of the cutter face.

15. The rotary apparatus of claim 12, wherein the group of at least two primary cutters and the third primary cutter are all positioned in a cone section of the cutting profile, a nose section of the cutting profile, or a shoulder section of the cutting profile.

* * * * *